US011273542B2

(12) United States Patent
Klotblixt

(10) Patent No.: US 11,273,542 B2
(45) Date of Patent: Mar. 15, 2022

(54) ELECTRIC PULSE TOOL WITH CONTROLLED REACTION FORCE

(71) Applicant: ATLAS COPCO INDUSTRIAL TECHNIQUE AB, Stockholm (SE)

(72) Inventor: Adam Klotblixt, Stockholm (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 306 days.

(21) Appl. No.: 16/313,809

(22) PCT Filed: Jun. 19, 2017

(86) PCT No.: PCT/EP2017/064923
§ 371 (c)(1),
(2) Date: Dec. 27, 2018

(87) PCT Pub. No.: WO2018/001775
PCT Pub. Date: Jan. 4, 2018

(65) Prior Publication Data

US 2019/0168364 A1 Jun. 6, 2019

(30) Foreign Application Priority Data

Jun. 30, 2016 (SE) ..... 1630170-7

(51) Int. Cl.
*B25B 23/147* (2006.01)
*B25B 21/00* (2006.01)
*B25B 21/02* (2006.01)

(52) U.S. Cl.
CPC ..... *B25B 23/1475* (2013.01); *B25B 21/00* (2013.01); *B25B 21/02* (2013.01); *B25B 23/147* (2013.01)

(58) Field of Classification Search
CPC ..... B25B 21/00; B25B 21/02; B25B 23/147; B25B 23/1475; B25B 23/14; B25B 23/1405
(Continued)

(56) References Cited

U.S. PATENT DOCUMENTS 6,680,595 B2 1/2004 Ito
7,770,658 B2 8/2010 Ito et al.
(Continued)

FOREIGN PATENT DOCUMENTS

EP 2650085 A2 10/2013
JP 2005144625 A 6/2005

OTHER PUBLICATIONS

International Search Report (ISR), Written Opinion, and International Preliminary Report on Patentability (IPRP) dated Aug. 31, 2017 issued in International Application No. PCT/EP2017/064923.
(Continued)

*Primary Examiner* — David B. Thomas
*Assistant Examiner* — Thomas Raymond Rodgers
(74) *Attorney, Agent, or Firm* — Holtz, Holtz & Volek PC

(57) ABSTRACT

An electric power tool, configured to perform tightening operations where torque is delivered in a series of pulses, includes an electrical motor adapted to drive a rotating shaft of the electric power tool, and an angle sensor for sensing a parameter related to an angular displacement of the electric power tool. The electric motor is adapted to be fed with a train of controlled current pulses. The electric power tool is adapted to control a current supplied in the current pulses based at least in part on an output signal from the angle sensor to not exceed a limit threshold value for the parameter related to an angular displacement of the electric power tool.

14 Claims, 3 Drawing Sheets

(58) Field of Classification Search
USPC ..... 81/464; 173/1, 5, 6, 176
See application file for complete search history.

(56) References Cited

U.S. PATENT DOCUMENTS

| | | | | |
|---|---|---|---|---|
| 2007/0084613 | A1* | 4/2007 | Zhang | B25F 5/001 173/1 |
| 2009/0014192 | A1* | 1/2009 | Ito | B23P 19/066 173/1 |
| 2013/0126202 | A1 | 5/2013 | Oomori et al. | |
| 2013/0269961 | A1* | 10/2013 | Lim | B25B 21/00 173/1 |
| 2016/0031072 | A1 | 2/2016 | Lim et al. | |

OTHER PUBLICATIONS

Japanese Office Action dated Jun. 28, 2021 issued in Japanese Application No. 2018-568425.

* cited by examiner

ELECTRIC PULSE TOOL WITH CONTROLLED REACTION FORCE

TECHNICAL FIELD

The invention relates to a pulsed electric power tool. In particular the invention relates to an electric power tool for performing tightening operations where torque is delivered in pulses to e.g. tighten and/or loosen screw joints.

BACKGROUND

Power assisted tools for fastening bolts, screws and nuts are used in a large field of applications. In some of those applications it is desired or even required to be able to control the clamping force or at least an associated torque. Such power assisted tools are typically controlled to rotate a shaft of the tool such that the torque is measured and when the torque reaches a predetermined value the electric power tool is controlled to stop the shaft rotation. This can for example be accomplished by cutting the power to the tool or a clutch can be slid.

A problem encountered when operating a power assisted tool, in particular a handheld power tool with a rotating shaft, is that the operator is subject to a reaction force. One way to reduce the reaction force transferred to the operator is to use a pulsed electric motor that is fed with a series of energy pulses driving the electric motor in a pulsed manner. The energy can typically be supplied as current pulses. Hereby, the reaction force that the operator needs to cope with can be reduced.

U.S. Pat. No. 6,680,595 describes a control method and a fastening apparatus for fastening a screw. The fastening apparatus is controlled to output a pulsed increasing torque. The actual torque is determined and the motor is stopped when the actual torque reaches a target value. The pulsed increasing torque is generated by feeding a pulsed increasing current to the electric motor of the fastening apparatus.

Also, U.S. Pat. No. 7,770,658 describes a control method and a fastening apparatus for fastening a screw. The actual torque is determined and the motor is stopped when the actual torque reaches a target value. Further, when the actual torque reaches a set value, the torque delivered by the fastening apparatus is reduced. The pulsed torque is generated by feeding a pulsed current to the electric motor of the fastening apparatus.

There is a constant desire to improve the operation of power assisted fastening tools. For example the reaction force transferred to the operator should be as small as possible to improve the working conditions of the operator. At the same time the fastening process should be fast and the variations in the resulting final torque should be small to guarantee that the end result of the fastening process is within set values.

Hence, there exists a need for an improved pulsed fastening method and apparatus to be used in a pulsed electric power tool.

SUMMARY

It is an object of the invention to provide an improved pulsed electric power tool, and a method for controlling the operation thereof.

This object is obtained by the methods and devices as set out in the appended claims.

In accordance with one embodiment an electric power tool comprising an electrical motor adapted to drive a rotating shaft of the electric power tool is provided. The electric motor is adapted to be fed with a train of controlled energy pulses. The electric power tool further comprises an angle sensor for sensing a parameter related to an angular displacement of the electric power tool. The electrical power tool is adapted to control the energy supplied in the energy pulses based at least in part on an output signal from the angle sensor. Hereby it is obtained that the energy fed to the electric motor will not cause one or many threshold levels relating to the angular displacement to be exceeded. This in turn will make it possible to achieve better ergonomics in the electric power tool.

In accordance with one embodiment the controlled energy pulses are current pulses. Current pulses can easily be controlled to quickly shift energy. For example duration or magnitude or both of the current pulses can be controlled based on the output signal from the angle sensor. By changing any of such parameter values the amount of energy in a particular pulse can be changed.

In accordance with one embodiment the angle sensor is a sensor adapted to sense at least one of an angular displacement, an angular velocity or an angular acceleration. By sensing one or more of these parameters it is possible to control the electric power tool to not exceed limit threshold values for one or more of angular displacement, angular speed or angular acceleration. This will improve the ergonomics. Also the threshold limits can be individually set for different tools to match the preference of an individual operator.

In accordance with one embodiment the electric power tool comprises a gear arrangement between the electric motor and the rotating shaft. In accordance with one embodiment the angle sensor is at least one of a gyro sensor or an accelerometer.

In accordance with one embodiment the electric power tool is adapted to control the pulse energy within a sensed pulse. In accordance with one embodiment the power tool is adapted to control the pulse energy between a sensed pulse and an upcoming pulse. The electric power tool can also be adapted to control the pulse energy within a sensed pulse and in an upcoming pulse, in particular a successive pulse to the sensed pulse.

The invention also relates to a method for controlling an electric power tool in accordance with the above and to a computer program adapted to perform such a method. The invention also extends to a controller for controlling the energy pulses in accordance with the above.

BRIEF DESCRIPTION OF THE DRAWINGS

The invention will now be described in more detail and with reference to the accompanying drawings, in which.

DETAILED DESCRIPTION

Conventional power tools such as nutrunners or screw drivers of today are typically provided with sensors, such as angle encoders or torque meters or both, which make it possible to control the quality of a performed work operation, such as the tightening of a joint.

Further, for hand held power tools in particular, it is important both that the reaction force that the operator is subject to is as low as possible and that the time of concluding a specific tightening operation is as short as possible. An operator may conduct many hundreds of tightening operations during a working cycle and it is therefore important that they are both ergonomic for the well-being of the operator and rapid for the productivity at the work station. An ergonomic tightening operation typically implies that the reaction torque is as low as possible or at least below some threshold value. It is also desired that the operator experiences low vibrations and low accelerations in the tool.

In order to control the reaction force, the electric power tool can be provided with a sensor that senses the angle of the electric tool or a parameter related to the angle such as the angular velocity or the angular acceleration. The sensor can for example be a gyro-sensor or an accelerometer or a combination thereof. The energy of a pulse in a sequence of energy pulses fed to the electric motor of the electric power tool is then controlled by a control unit based on the output signal from the sensor(s). The controller can both be provided inside the electric power tool or as a separate unit external to and in communication with the electric power tool. Thus, if a sensed pulse results in a signal indicating a large reaction force, the energy of the pulse or a next pulse can be controlled to a reduced value to reduce the reaction force. Hereby it is possible to dynamically control the reaction force in a tightening operation when using an electric power tool.

Figure 1:
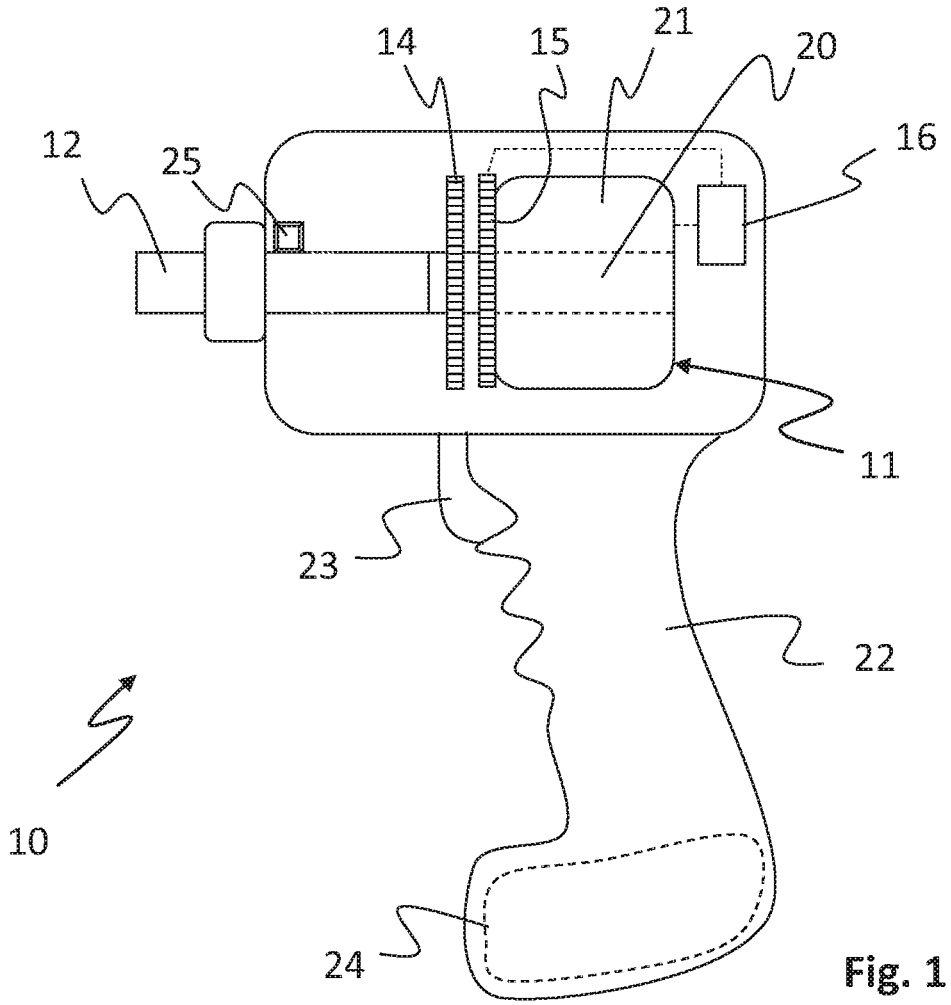
FIG. 1 shows a longitudinal section through a power tool.

FIG. 1 depicts an exemplary electric power tool 10 in accordance with an embodiment of the invention. The tool 10 is configured to perform tightening operations where torque is delivered in a series of pulses to tighten screw joints or a similar action involving a rotational action performed by the tool 10. For this purpose the pulse tool comprises an electric motor 11 having a rotor 20 and a stator 21. The electric motor 11 can be arranged to be rotated in two opposite rotational directions, clockwise and counter clockwise.

The tool 10 further comprises a handle 22, which is of a pistol type in the shown embodiment. The invention is however not limited to such a configuration but can be applied in any type of power tool and not limited to the design of FIG. 1. A power supply 24 is connected to the motor 11. In the embodiment shown the power supply is a battery that can be arranged in the lower part of the handle. Other types of power supplies are also envisaged such as an external power supply supplying power via an electrical cable to the tool 10. The tool 10 can further comprise a trigger 23 arranged for manipulation by the operator to control the powering of the electrical motor 11. In some embodiments the tool 10 is connected to an external control unit (not shown). The external control unit can supply the tool 10 with electrical power. The control unit can also be arranged to transmit and receive signals to/from the tool 10 to control the tool.

Further, the tool comprises an output shaft 12 and can also comprise different sensor(s) 14, 15, 25 for monitoring one or more parameters relating to the operation performed by the tool 10. Such parameters can typically be a delivered torque pulse, etc. The sensor(s) may for example be one or more of a torque sensor, an angle sensor, an accelerometer, a gyro sensor, or the like. In particular at least one sensor 14, 15, 25 is adapted to sense an angular parameter of the electric power tool 10. The angle sensor used to sense the angular parameter can for example be a gyro-sensor or an accelerometer or both. The angular parameter sensed can for example be an angular displacement of the electric tool, an angular velocity of the electric tool or the angular acceleration of the electric tool. Further the power tool 10 can in accordance with some embodiments have the output shaft 12 connected to the motor 11 via a gear arrangement (not shown).

A control unit 16 is arranged to control the electric motor 11. In the embodiment shown the control unit 16 is provided integrated in the tool 10. However, the control unit can also be located in an external unit and connected by wire or wirelessly to the tool 10. The sensor(s) 14, 15, 25 can typically be arranged to provide information regarding the monitored parameter(s) to the control unit 16. This is conventional in controlled tightening operations where the tightening is governed towards a specific target value, such as target torque, angle or clamp force.

The control unit 16 can be adapted to control the energy fed to electric motor by feeding the electric motor with electrical pulses. In the embodiment shown herein the electric pulses are controlled by controlling the current fed to the electric motor 11. However, other methods of controlling the pulsed energy fed to the electric motor is also envisaged such as control of the duration of the pulses, the voltage or the like.

In accordance with one embodiment the control unit 16 receives a signal from a sensor corresponding to an angular parameter of the electrical tool. The angular parameter is used to determine an angular displacement of the electric tool resulting from a pulse of the pulse train fed to the electric motor. Based on the angular displacement the energy of a pulse fed to the electric power tool is controlled. The controlled pulse can be the current (present) pulse or an upcoming pulse. By controlling the energy of a pulse based on a determined angular displacement of the electric power tool caused by a pulse it is possible to adjust the reaction force felt by an operator to a level where the electric power tool is comfortable to use. The control can be used to both control the angular displacement or the acceleration or both to be within pre-set limit values.

Figure 2:
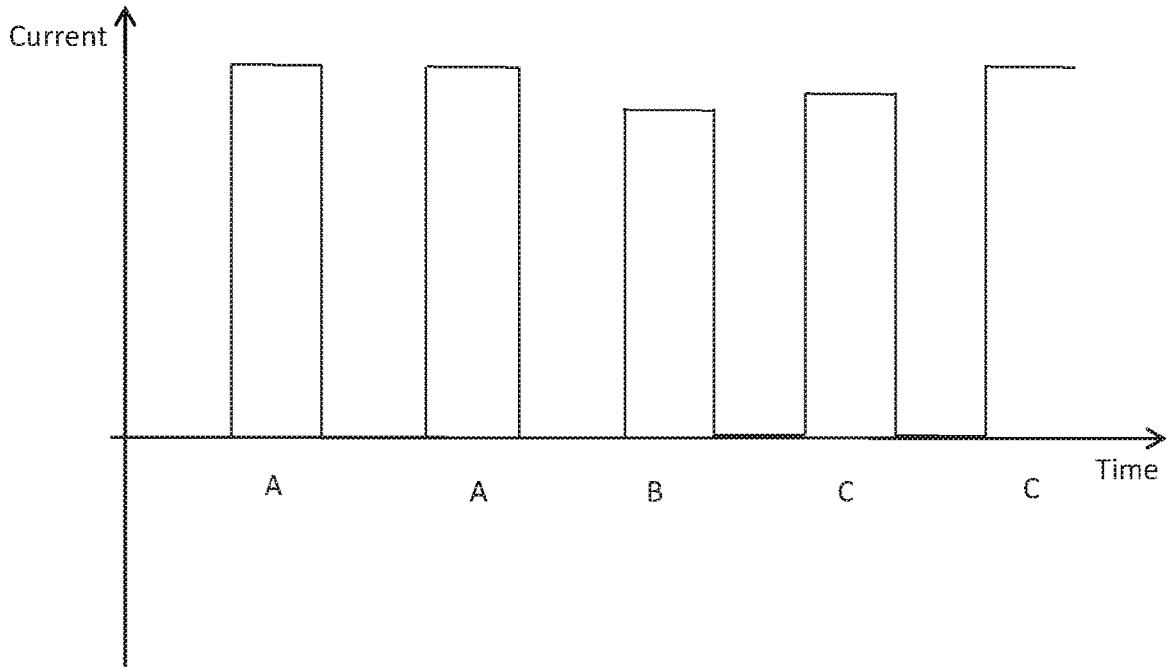
FIG. 2 depicts a diagram of a current pulse sequence used in operation of a power tool.
Figure 3:
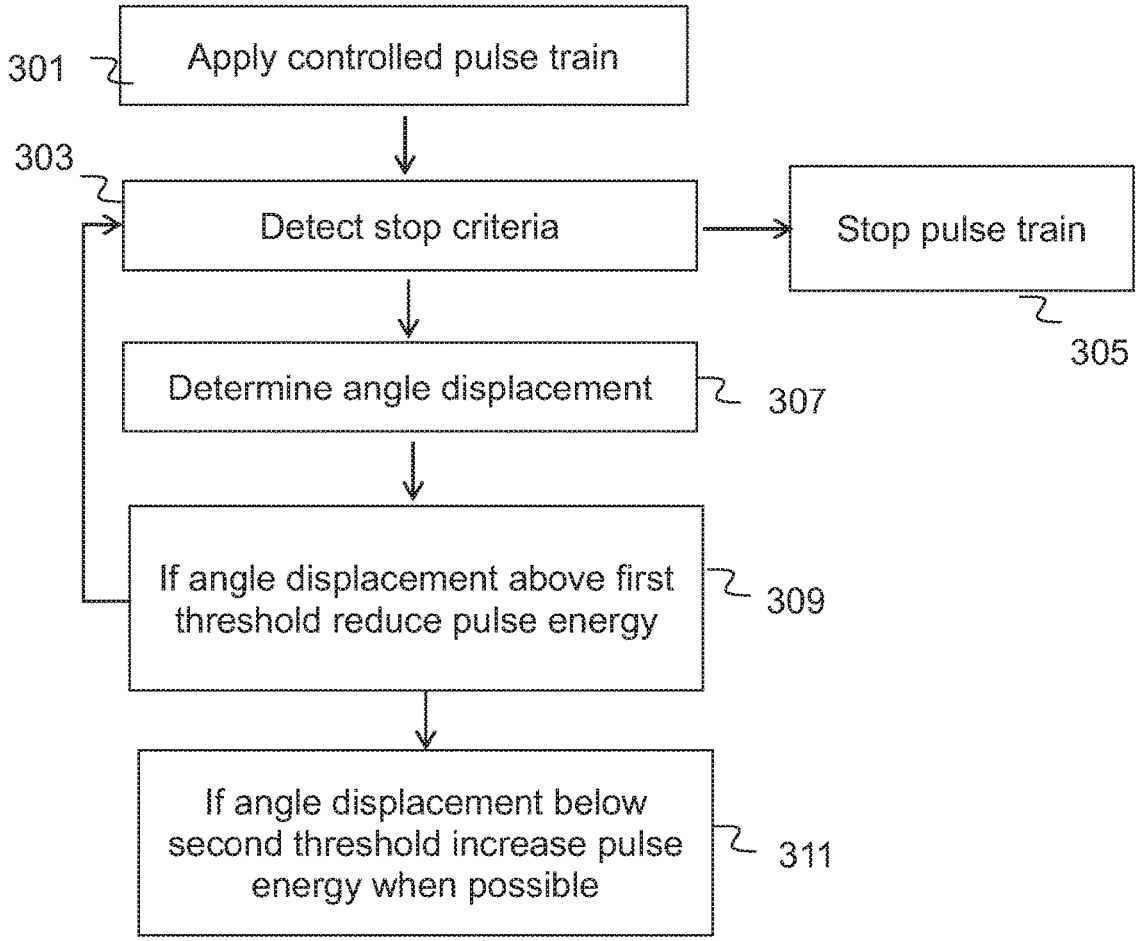
FIG. 3 is a flow chart illustrating some steps when controlling a power tool.

In FIGS. 2 and 3 a flowchart illustrating some exemplary steps when controlling current to a power tool during operation in accordance with some embodiments is shown. FIG. 2 depicts a diagram of a current pulse sequence being a part of a pulse train used in operation of a power tool such as the power tool 10 of FIG. 1 or any other electrically powered power tool comprising an electric motor. The electric motor of the power tool is fed with a pulsed current for driving the power tool in a tightening direction wherein a joint is tightened. First, in a step 301, a pulse train is provided to the motor in accordance with the exemplary procedure of FIG. 3. This can be performed by supplying a current pulse train with a current pulse A (see FIG. 2) having a predetermined magnitude. Next, in a step 303, it is determined if a stop criteria is fulfilled such as if a detected torque reaches a pre-determined value. Then, in a step 305, the current pulse train is stopped when the stop criteria is fulfilled. If no stop criteria is detected the procedure proceeds to a step 307. In step 307 the angular displacement of the tool (or a parameter related thereto) is determined. Based on the determination made is step 307 it is determined in a step 309 if the angular displacement of the tool is above a predetermined threshold and if the angular displacement is determined to be above the predetermined threshold, the pulse energy of a pulse is reduced. Such a scenario is depicted in FIG. 2 at Pulse B which has a reduced energy compared to a previous pulse. The procedure can then return to step 303 or proceed to a step 311. In step 311 it is determined if the angular displacement is below a threshold. If the angular displacement is below the threshold the energy of a new pulse can be increased (provided that there is no other limitation limiting the energy supplied in the new pulse). This is shown in FIG. 2 at pulses C. However when a maximum energy is reached as limited by some other parameter, the energy pulse will no longer be increased. For example the tool can have a maximum energy that it can deliver or other limitations may apply.

In the above exemplary embodiment the current magnitude between pulses is controlled based on an angular displacement. However other control methods are also envisaged. For example the parameter related to angular displacement can be the angular speed or the angular acceleration. The pulse energy can then be controlled to keep the angular speed or angular acceleration within pre-determined limit values. Also any combination of limit values can be formed and the pulse energy can be controlled to not exceed any of such limit values. Further, the pulse energy can also be controlled for a measured pulse. For example, when during a pulse, a limit value is exceeded the energy supplied to the pulse can be stopped or reduced. Hereby, intra pulse control of a parameter such as one or more of angular displacement, angular speed or angular acceleration of the tool can be achieved.

The method of controlling an electric power tool as described herein is advantageously computer implemented. Further a controller used to control the pulse energy can be located either inside the electric power tool or in accordance with some embodiment located outside the electric power tool as an external controller unit.

The invention claimed is:

1. An electric power tool configured to perform a tightening operation in which torque is delivered in a series of pulses, the electric power tool comprising:

an electrical motor configured to drive a rotating shaft of the electric power tool;

an angle sensor for sensing a parameter related to an angular displacement of the electric power tool for determining a reaction torque on a user; and a controller configured to control the electric power tool to feed the electrical motor a train of controlled current pulses to drive the electrical motor to perform the tightening operation and to control a current supplied in the current pulses based at least in part on an output signal from the angle sensor so that the reaction torque on the user of the electric power tool is below a threshold value, wherein the controller is configured to reduce a pulse energy of at least one of the current pulses in response to the parameter related to the angular displacement exceeding an angular displacement threshold value, and wherein the controller is configured to, after reducing the pulse energy of the at least one of the current pulses, increase the pulse energy of a subsequent current pulse, in response to the parameter related to the angular displacement falling below the angular displacement threshold value.

2. The electric power tool according to claim 1, wherein the controller controls at least one of a duration and magnitude of the current pulses based on the output signal from the angle sensor.

3. The electric power tool according to claim 1, wherein the angle sensor is at least one sensor configured to sense at least one of an angular displacement, an angular velocity or an angular acceleration.

4. The electric power tool according to claim 2, wherein the angle sensor is at least one sensor configured to sense at least one of an angular displacement, an angular velocity or an angular acceleration.

5. The electric power tool according to claim 1, wherein the electric power tool further comprises a gear arrangement between the electric motor and the rotating shaft.

6. The electric power tool according to claim 2, wherein the electric power tool further comprises a gear arrangement between the electric motor and the rotating shaft.

7. The electric power tool according to claim 3, wherein the electric power tool further comprises a gear arrangement between the electric motor and the rotating shaft.

8. The electric power tool according to claim 1, wherein the angle sensor is at least one of a gyro sensor or an accelerometer.

9. The electric power tool according to claim 2, wherein the angle sensor is at least one of a gyro sensor or an accelerometer.

10. The electric power tool according to claim 1, wherein the controller is configured to control the energy within a sensed pulse.

11. The electric power tool according to claim 1, wherein the controller is configured control the energy between a sensed pulse and an upcoming pulse.

12. A method of controlling an electric power tool configured to perform a tightening operation in which torque is delivered in a series of pulses, wherein the electric power tool includes an electrical motor configured to drive a rotating shaft of the electric power tool, and an angle sensor for sensing a parameter related to an angular displacement of the electric power tool for determining a reaction torque on a user, the method comprising:

feeding the electrical motor a train of controlled current pulses to drive the electrical motor to perform the tightening operation, and controlling a current supplied in the current pulses based at least in part on an output signal from the angle sensor so that the reaction torque on the user of the electric power tool is below a threshold value, wherein the controlling comprises reducing a pulse energy of at least one of the current pulses so that the reaction torque on the user of the electric power tool is below the threshold value, and wherein the controlling comprises, after reducing the pulse energy of the at least one of the current pulses, increasing the pulse energy of a subsequent current pulse.

13. A non-transitory computer readable storage medium storing a computer program code which, when executed on a computer, causes the computer to perform the method according to claim 12.

14. A controller for an electric power tool configured to perform a tightening operation in which torque is delivered in a series of pulses, wherein the electric power tool includes an electrical motor configured to drive a rotating shaft of the electric power tool, and an angle sensor for sensing a parameter related to an angular displacement of the electric power tool for determining a reaction torque on a user, wherein the controller is configured to control the electric power tool to feed the electrical motor a train of controlled current pulses to drive the electrical motor to perform the tightening operation and to control a current supplied in the current pulses based at least in part on an output signal from the angle sensor so that the reaction torque on the user of the electric power tool is below a threshold value, wherein the controller is configured to reduce a pulse energy of at least one of the current pulses in response to the parameter related to the angular displacement exceeding an angular displacement threshold value, and wherein the controller is configured to, after reducing the pulse energy of the at least one of the current pulses, increase the pulse energy of a subsequent current pulse, in response to the parameter related to the angular displacement falling below the angular displacement threshold value.

* * * * *